United States Patent [19]

Zippwald, Sr.

[11] Patent Number: 4,504,995

[45] Date of Patent: Mar. 19, 1985

[54] PLAYING CARD CLEANING APPARATUS

[76] Inventor: John C. Zippwald, Sr., 3950 Las Vegas Blvd., Las Vegas, Nev. 89119

[21] Appl. No.: 458,611

[22] Filed: Jan. 17, 1983

[51] Int. Cl.[3] ..... B08B 1/02

[52] U.S. Cl. ..... 15/102; 15/77; 134/9

[58] Field of Search ..... 15/77, 102; 51/18, 23; 134/6, 9

[56] References Cited

U.S. PATENT DOCUMENTS

| | | | |
|---|---|---|---|
| 1,586,905 | 6/1926 | Leightlitner | 15/102 X |
| 2,500,568 | 3/1950 | Puschel et al. | 15/102 |
| 3,098,249 | 7/1963 | Tice et al. | 15/102 X |
| 3,800,349 | 4/1974 | Green | 15/102 X |
| 4,129,919 | 12/1978 | Fitch et al. | 15/77 X |

FOREIGN PATENT DOCUMENTS

| | | | |
|---|---|---|---|
| 126180 | 1/1932 | Fed. Rep. of Germany | 15/77 |

*Primary Examiner*—Edward L. Roberts

*Attorney, Agent, or Firm*—William H. Maxwell

[57] ABSTRACT

A playing card cleaning apparatus, wherein individual cards are separated from a deck thereof and fed under compression between a first pair of traction rollers and scrubbing rollers wetted with a thin film of cleaning solution and withdrawn under tension between a second pair of traction rollers and said scrubbing rollers, the scrubbing rollers squeezing the thin film of cleaning solution rearwardly therefrom and leaving the cards damp, and wherein drying means of absorbent belting wipes moisture from the cards and discharges them into a receiver, employing a liquid cleaning solution of soda water and nonionic-cationic cleaning agents applied to wet the cards that are simultaneously scrubbed and from which said solution is squeezed.

5 Claims, 14 Drawing Figures

54
55
54'
55'
DRYING LOOP

D
60
FLEXED CARDS
54
54'
56
57
58
59
55
55'
61
DRYING LOOP
X
R

10
B
21
21
24
25
20
10

21
25
21

PLAYING CARD CLEANING APPARATUS

BACKGROUND

Gaming houses, casinos, and the like are the consumers of large number of playing card decks, each comprised of 52 basic cards used in conducting various games such as Poker, Blackjack and Bakerat. The standardized sizes of playing cards vary, the smaller cards being $2\frac{1}{4}\times3\frac{1}{2}$ inch, and the larger cards being $2\frac{1}{2}\times3\frac{1}{2}$ inch. These are the widely used sizes, the more expensive and permanent cards being made of plastic. At the present day, there is a transition from the more expendable paper cards to the more permanent plastic cards, however continued use of such cards requires their cleaning from time to time, as they are handled by countless numbers of persons. Furthermore, the card players demand clean cards, and it has been the practice of the gaming houses, and casinos, to wash them by hand, and all of which is time consuming but quite necessary as the plastic cards which are now widely used are also quite expensive. Therefore, it is a general object of this invention to provide an apparatus for the cleaning of playing cards, whether they be of paper or plastic, and whether they be of the small or large standard size.

Playing cards are made of stiff paper or plastic of about 0.012 inch in thickness and having a hard and smooth finish. They are susceptible to becoming dirty when handled by person after person, it being an object of this invention to clean playing cards in public establishments, for the purpose of improving health conditions, as well as to enhance the condition of the cards and preserve them. The apparatus for cleaning playing cards as it will be described herein, involves, separation of individual cards from a deck thereof and sequentially feeding the same, scrubbing said individual cards, drying said individual cards, and re-establishing the cards in deck formation. It is an object of this invention to automate the foregoing generalized process steps by providing complementary means therefor. With the present invention, automation is by electric motor means and inherently synchronized and virtually jamb-proof, there being the discrete application of a liquid solution whereby the individual cards are wetted and then dried.

Decks of playing cards are commonly stored in shoes of one or more decks, and it is such a shoe in which decks of cards are loaded into the apparatus of the present invention, It is an object of this invention to provide a separating means that withdraws one card at a time from the shoe supply thereof and feeds them sequentially to a scrubbing means. It is also an object of this invention to provide a scrubbing means that applies a minimal amount of liquid cleaning solution to both sides of the cards while transporting them to a drying means. And it is also an object of this invention to provide a drying means that wipes and absorbs moisture from the opposite sides of the cards and delivers them into a receptacle for their subsequent use in a cleaned condition.

A characteristic feature and advantage of the apparatus as it will be hereinafter disclosed is the use of minimal liquid in performing the scrubbing step, and the use of softening agents of the nonionic and cationic types. It is an object of this invention to reduce and/or to prevent "static cling", which would otherwise interfere with the transport and discharge of the playing cards. With the present invention the aforesaid softening agents are in a solution of carbonated water transferred to the opposite sides of the cards in a thin film simultaneously with a scrubbing action.

SUMMARY OF THE INVENTION

This invention relates to the cleaning of high quality playing cards and particularly those made of plastic, and of either of the two aforesaid standard sizes. The cards are loaded into a feed shoe in a stack of one to eight decks at a time, for the continuous feeding of a single card at a time and one separated from the other. Accordingly, there is a separating means that withdraws individual cards from the shoe and deposites them into a chute leading to a process plane to be engaged by the scrubbing means.

The cards are simultaneously wetted and scrubbed as they progress through the scrubbing means in the plane of processing, transported forwardly by traction rollers and into engagement with the scrubbing rollers. There is a speed differential between the traction and scrubbing rollers, and the frictional engagement is greater with the traction rollers than with the scrubbing rollers, so that the latter has its cleaning effect. A feature is that the peripheral speed of the preceeding traction rollers is greater than that of the following scrubbing rollers. Another feature is the application of a thin film of cleaning solution onto the scrubbing rollers by means of a transfer roller, whereby the cards are "wetted" as distinguished from being drenched or immersed, and whereby the coefficient of friction between the cards and scrubbing rollers is controllably reduced. In accordance with the method performed there is a simultaneous scrubbing and wetting of the cards transported at one rate by traction rollers and rubbed at another rate by scrubbing rollers from which a thin film of cleaning solution is applied to the cards to "wet" them. The cleaning solution is comprised of softening agents of the nonionic and cationic types with sodium bicarbonate in water. The cards issue from the scrubbing means in a damp condition as a result of the "squeeze" effect of the rollers which eliminate the wetted surfaces from the cards.

The drying means follows in the process plane and receives the damp cards as they issue from the scrubbing means. Drying is by wiping with moisture absorbent toweling belts between which the cards are drawn in a surpentine manner to have a wiping action, each belt having an evaporation loop that eliminates moisture.

Delivery of the cleaned cards is from the drying belts and into a receptacle from which they are taken for reuse. A divider card can be inserted between decks to distinguish them.

The foregoing and various other objects and features of this invention will be apparent and fully understood from the following detailed description of the typical preferred form and application thereof, throughout which description reference is made to the accompanying drawings.

PREFERRED EMBODIMENT

Figures 1, 2:
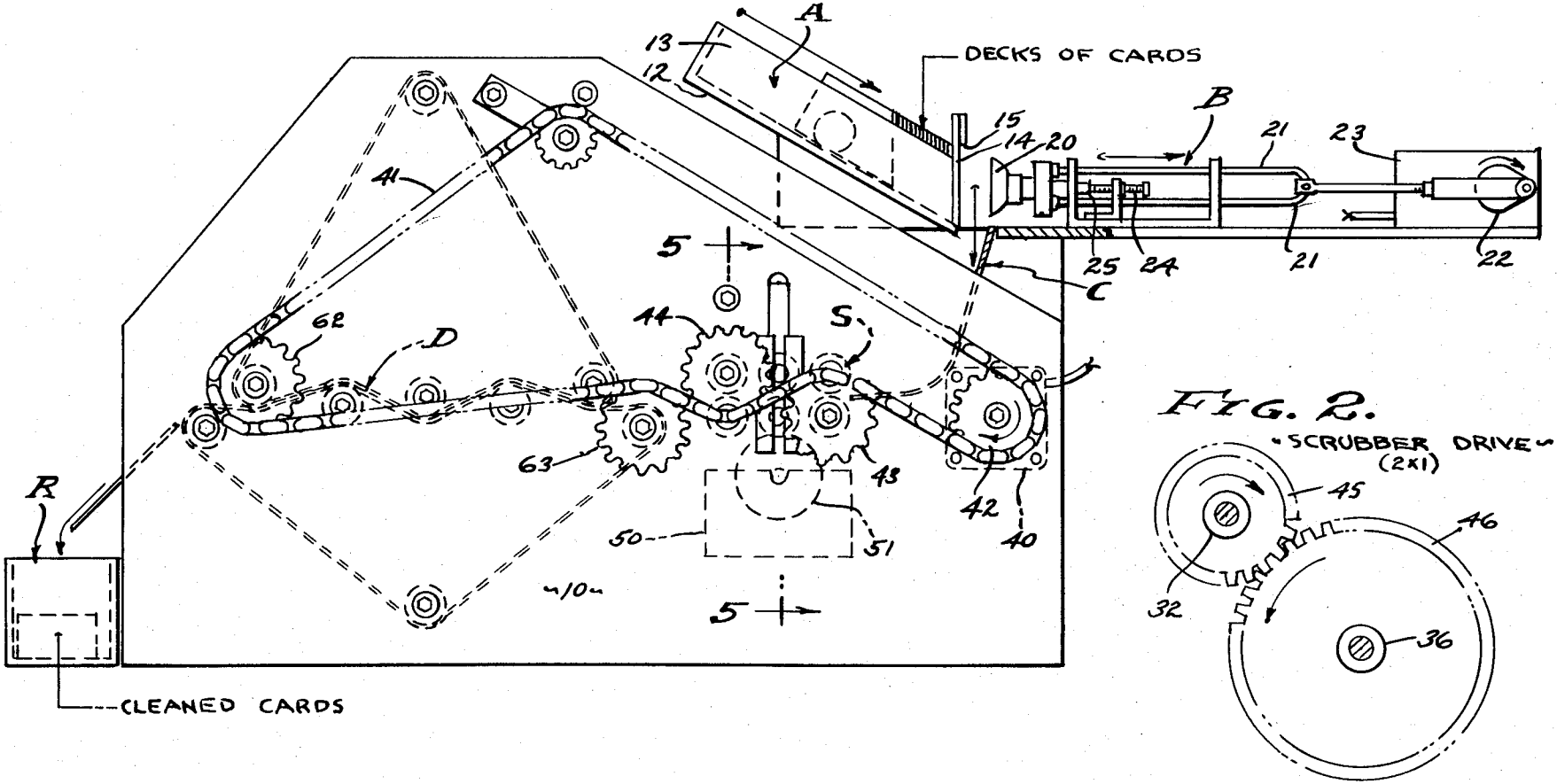
FIG. 1 is a side elevation of the apparatus of the present invention.
FIG. 2 is an enlarged fragmentary view of the gear reduction drive to the scrubbing means.

Referring now to the drawings, there is an apparatus whose mode of operation carries out a process characterized by the use of a nonionic-cationic cleaning solution applied to wet the playing cards that are sequentially scrubbed. Decks of playing cards are stacked in a feed shoe A from which they are individually withdrawn and dropped into a feed chute C and directed thereby to a processing plane x. At the plane x there is a scrubbing means S that receives the cards and advances them in spaced sequence while simultaneously wetting and scrubbing the same. The scrubbed cards issue from the scrubber means in a damp condition and are then trained through a drying means D that wipes them clean, to be delivered into a receptacle R for subsequent reuse in a cleaned and wiped dry condition. The apparatus is a powered machine comprised of plate-like side members 10 and 11 between which the aforesaid elements and means are carried and operate. The playing cards feed by gravity and the feed shoe A is carried by and above the frame where it is open to receive a plurality of decks of said cards. The receptacle R is located at an end of the apparatus-machine where the decks of cards are sequentially stacked by gravity after cleaning.

Figure 12:
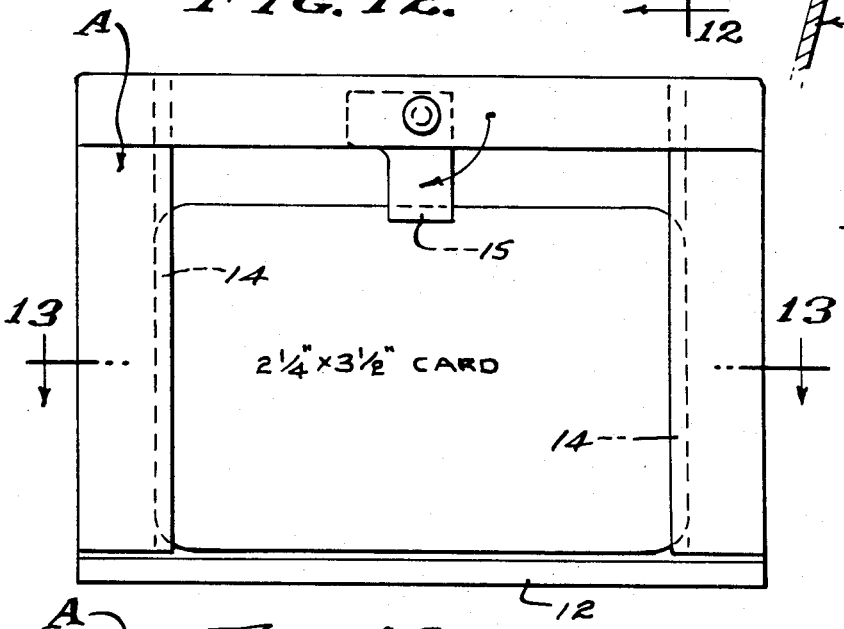
FIG. 12 is a view taken as indicated by line 12—12 on FIG. 11.
Figure 14:
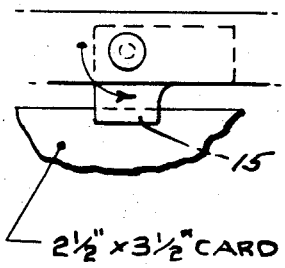
FIG. 14 is a fragmentary view of a portion of FIG. 12 showing an alternate positioning of parts to accommodate a larger sized playing card.
Figure 13:
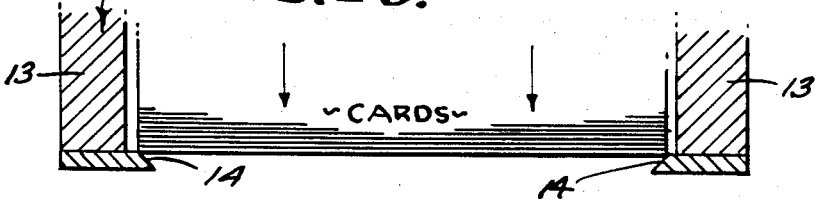
FIG. 13 is a sectional view taken as indicated by 13—13 on FIG. 12.

The feed shoe A is an inclined trough of channel configuration, open upwardly to receive decks of playing cards with each card disposed in a transverse vertical plane. In practice, the feed shoe A has a bottom 12 inclined at 30° and down which the decks of cards slide by means of gravity between opposite side guide rails 13, to be arrested against vertical side stop shoulders 14 and against a central top stop shoulder 15. The stop shoulders are forwardly and inwardly beveled as shown so as to releasably engage the margins of the foremost card, the top stop shoulder 15 being adjustable to reach either 2¼ or 2½ inch width playing cards (see FIGS. 12, 13 and 14). Vertical disposition and advancement of the playing cards is ensured by a follower 16 having a roller support 17 upon bottom 12 and a transverse vertical front face 18 to engage the back-most card and thereby force it and the deck or decks thereof forwardly into engagement with the vertically disposed stop shoulders 14 and the adjusted stop shoulder 15. Accordingly, the playing cards are successively forced into a transverse vertically disposed feed plane y from which they are individually withdrawn by the separating means B next described.

The separating means B is a pneumatic device that withdraws the foremost playing cards successively from the feed shoe A, and drops them in timed relation into the feed chute C. The means B is motor driven and has a crank and reciprocating motion that advances and retracts a suction member engageable with each successive playing card. As shown, the feed shoe A overlies the scrubbing means S with the separating means B disposed horizontally in alignment with the foremost exposed playing card; alternately the separating means B can overlie the scrubbing means S. The suction member is a suction cup 20 of supple rubber or the like carried by a rod or rods 21 slideable to reciprocate into and out of pressured engagement with the foremost playing card. When the suction cup 20 is pressed against said card, the chamber thereof is reduced and suction established when withdrawn, by its peripheral seal; whereby the card is withdrawn from the stops 14 and 15 when the rod or rods 21 retract. Advancement and retraction of the rod or rods 21 is by means of crank and connecting rod 22 driven from a motor and gear box unit 23, operating for example at 20 RPM. After withdrawal of the foremost playing card from the feed shoe A, suction within suction cup 20 is broken and/or released to atmosphere by an adjustably fixed pin 24 engageable with the operating stem of a check valve 25 carried with the base of the reciprocable suction cup 20. Accordingly, at the end of the withdrawing cycle the withdrawn card is released so as to drop separately by means of gravity into the feed chute C.

The feed chute C transfers the separate playing cards from the separating means B to the scrubbing means S, and so that they are disposed coincidental with the processing plane x. The feed chute C is a slide that receives the vertically disposed playing cards, parallel to and offset from plane y, and turns them to a horizontal disposition by means of its downwardly and forwardly curved form, as shown. In practice, the playing cards slide down and from the terminal front end 26 of the slide-chute where they issue separately into and between the traction rollers of the scrubbing means S next described.

The scrubbing means S simultaneously wets and scrubs each individual playing card, as it issues from the feed chute C. It is the means S which characterizes this invention, in that the traction rollers thereof operate at a peripheral rate of speed greater than that of the scrubbing rollers thereof. Pairs of rollers are spaced closer than the widths of the playing cards, so that they are constantly engaged and supported. A feature is that there are traction rollers 30–31 preceding the scrubbing rollers 35–36; in each instance a pair of pinch rollers. Consequently, the planar cross section of the playing card is in compression during its movement between the preceding compression rollers 30–31 and suceeding rollers 35–36. Another feature is that there are tension rollers 32–33 succeeding the scrubbing rollers 35–36, and consequently the playing card is in tension during its movement between the succeeding rollers 32–33 and preceding rollers 35–36. The rollers are made with surfaces of resilient or compressive material such as rubber or the like, and preferably of sponged plastic that is supple and resilient. In carrying out this invention the traction rollers 30–31 and 32–33 are substantially harder and more firm than the scrubbing rollers 35–36, thereby establishing greater frictional contact with the cards and the compression and tension conditions as the playing cards progress from the preceding to the succeeding traction rollers. Accordingly, there is a constant slippage and scrubbing action at the scrubbing rollers 35–36 of lesser frictional contact with the cards.

The peripheral engagement of the aforesaid traction rollers 30–31 and 32–33 and of the scrubbing rollers 35–36 is coplanar and coincidental with the processing plane x. The interengagement of said rollers is compressive and adjusted by spacing the axes thereof and/or by selecting the desired firmness thereof. The diameter of said rollers can be varied, but are preferably alike and the pairs thereof closely related and of relatively small diameter, so that the $2\frac{1}{4}$ and $2\frac{1}{2}$ inch width of the playing cards is always engaged in compression or in tension as above described. In practice, transverse guide rods 34 juxtapositioned above and below the processing plane x intermediate the preceding traction rollers 30–31 and the scrubbing rollers 35–36 ensures that the playing cards under compression therebetween do not bend or buckle.

Figure 3:
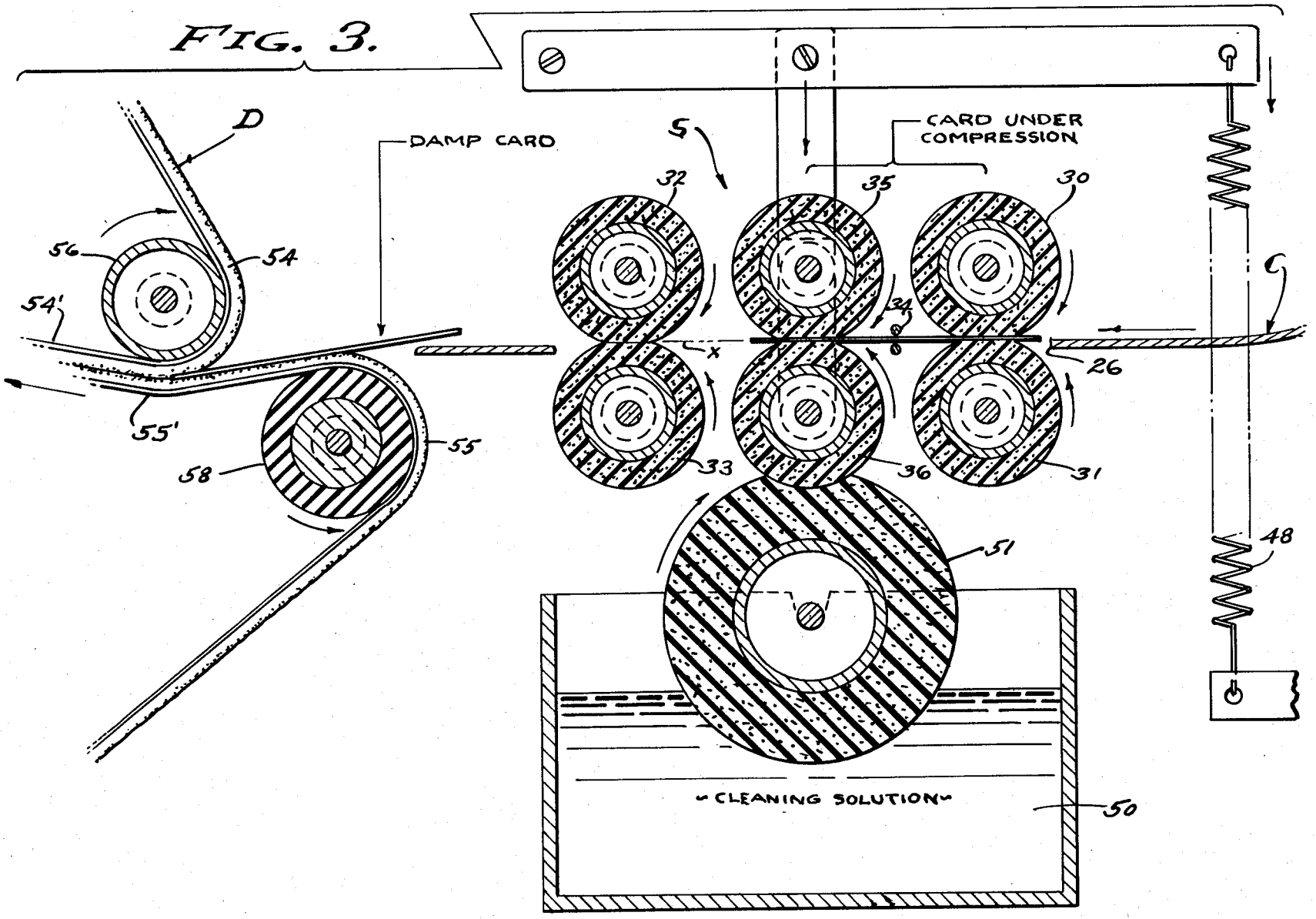
FIG. 3 is an enlarged view of a portion of the apparatus shown in FIG. 1, illustrating a playing card under compression in the scrubbing means, and a card entering the drying means.
Figure 4:
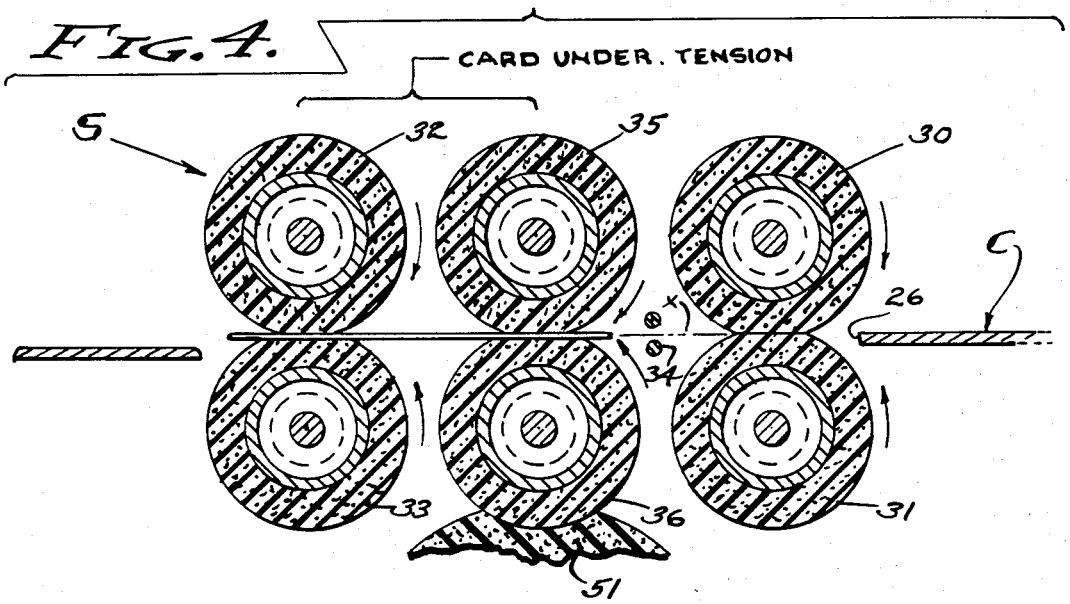
FIG. 4 is a view similar to a portion of FIG. 3, illustrating a playing card under tension in the scrubbing means.
Figure 5:
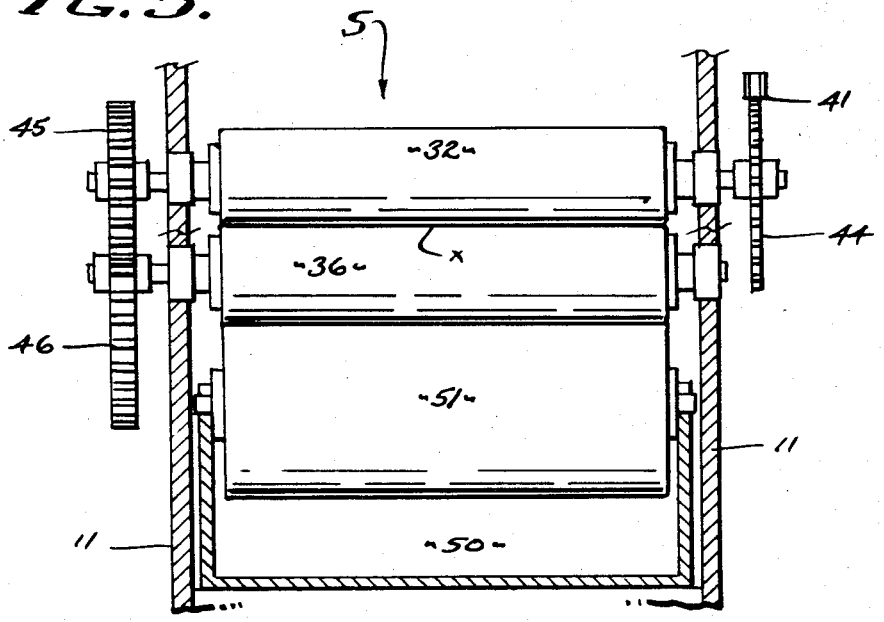
FIG. 5 is an enlarged sectional view taken substantially as indicated by line 5—5 on FIG. 1, illustrating the scrubber roller drive and wetting thereof.
Figure 6:
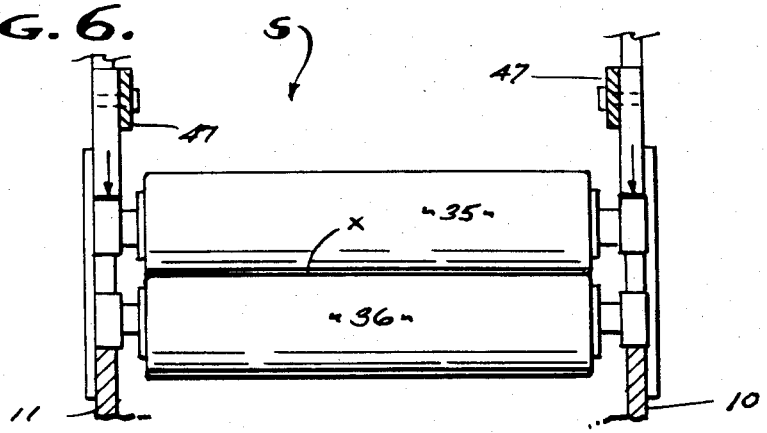
FIG. 6 is a view similar to FIG. 5, illustrating the pressure application to the top scrubber roller.

The aforesaid traction and scrubbing rollers are substantially wider than the playing cards disposed transversely therebetween, and are positively driven by a motor and gear box drive unit 40, through a chain 41 and sprocket 42 drive. As shown, one of each pair of rollers is driven by a sprocket, there being a sprocket 43 driving the lowermost roller 31, and a sprocket 44 driving the uppermost roller 32, both in the same forward direction of rotation. Although the chain 41 could have a sprocket drive to the scrubbing rollers, it is preferred that there be a gear reduction drive from one of said traction rollers to a scrubbing roller and shown herein in FIG. 2 as a 2 to 1 gear drive from traction roller 32 to scrubbing roller 36 turned in the same forward direction of rotation. The traction rollers are journaled in the side members 10 and 11 on antifriction bearings, and with the chain 41 and sprocket drive placed outside one of said side members. The end of traction roller 32 opposite the sprocket 44 carries a pinion gear 45 that meshes with a drive gear 46 fixedly positioned on the roller 36, the roller 36 being journaled in the side members 10 and 11 on anti-friction bearings. Adjusted pressure is applied to the opposite anti-friction bearing journals of rollers 35 by means of pressure bars 47 yieldingly urged downwardly by tension springs 48 (see FIG. 3) adjusted and/or selected as circumstances require.

The scrubbing means S is dependent for its operation upon the application of a liquid cleaning media to both sides of the playing cards, as they are transported under compression and tension along the processing plane x. In accordance with this invention, this cleaning media is involved in the cleaning process as it is later disclosed and applied in a thin film. Accordingly, the scrubbing means S includes a basin 50 in which a transfer roller 51 is immersed in a liquid and wetted, roller 51 being made with a resilient or compressive surface of soft material such as rubber or the like, and preferably of sponged plastic that is soft and supple and resilient. In practice, the roller is depressibly engaged with the lowermost scrubbing roller 36 and is substantially larger in diameter (2X) than said scrubbing roller. Since the scrubbing roller 36 is driven, the transfer roller 51 is revolved thereby and its surface continuously re-wetted as it turns through the basin 50. The basin 50 is in the form of a tray that is removeable for cleaning and re-filling, with cleaning media. As the rollers 35, 36 and 51 revolve, a liquid film is transferred from the surface of roller 51 onto the surface of roller 36, and thence from roller 36 onto the surface of roller 35 during the interval between the spaced playing cards. Since the rollers 35, 36 and 51 have depressed interengagement there is a "squeegee" action that establishes a thin liquid film which is then applied to the top and bottom sides of the playing cards as they are transported along the processing plane x.

The apparatus-machine thus far described squeegees or squeezes the aforesaid liquid cleaning film rearwardly with respect to the forward motion of the playing cards transported by the pairs of rollers 30–31 and 32–33. It is the scrubbing rollers 35–36 that have the squeegee action, since they are positively driven at a slower rate than rollers 30–33. Consequently, liquid is squeezed off the trailing and transverse side edge of each successive playing card, said liquid dropping by gravity into the basin 50. As a result, the squeezed playing cards issue from the scrubbing rollers 35–36 and are drawn under tension through the tension rollers 32–33 in a damp condition, the thin film of cleaning liquid having been squeezed therefrom.

Figures 7, 8, 9, 10:
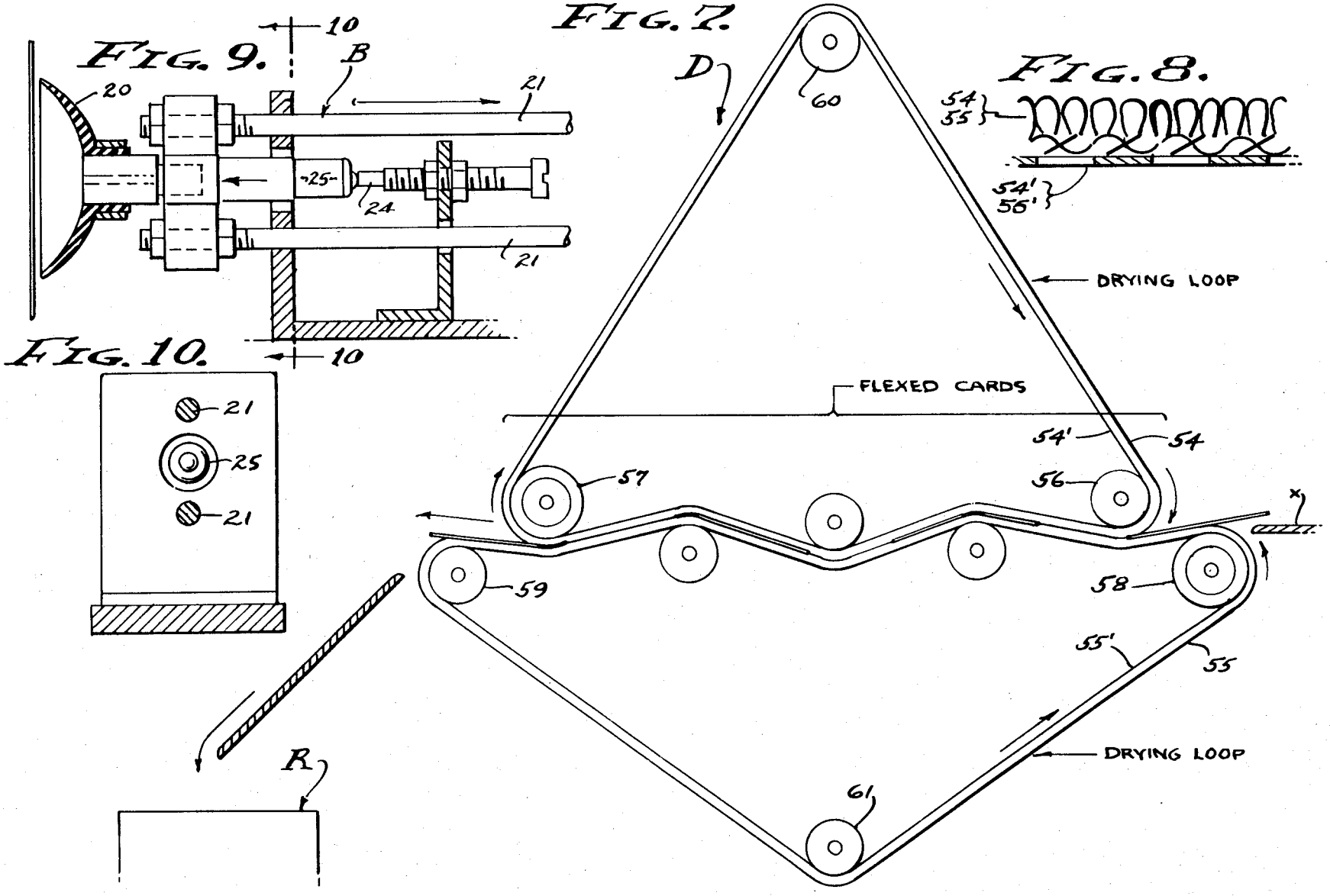
FIG. 7 is an enlarged detailed view of the drying means and its discharge into a playing card receiver.
FIG. 8 is an enlarged fragmentary sectional view of the moisture absorbent belting of the drying means.
FIG. 9 is an enlarged detailed fragmentary view of the separating means, illustrating its retracted position and discharge of a playing card for processing.
FIG. 10 is a sectional view taken as indicated by line 10—10 on FIG. 9.
Figure 11:
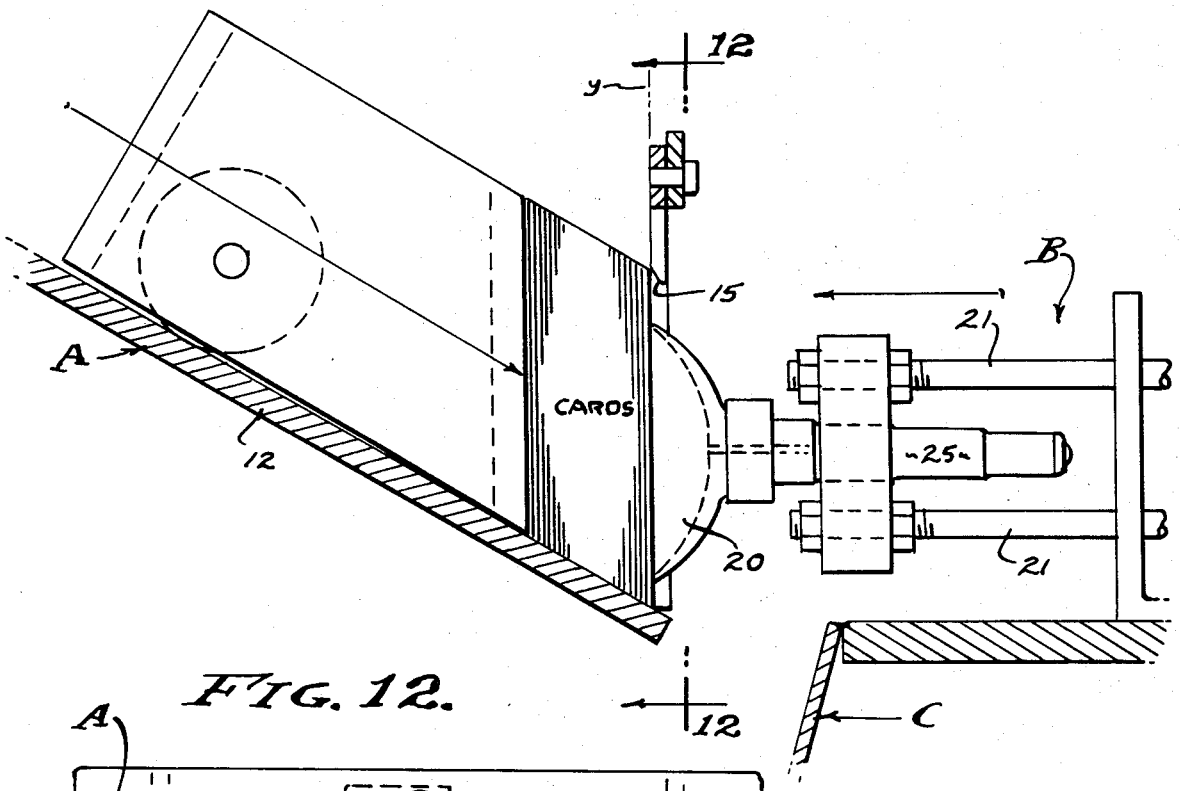
FIG. 11 is an enlarged detailed fragmentary view of the separating means, illustrating its advanced position receiving a playing card from the feed shoe.

The drying means D wipes and absorbs moisture from the top and bottom sides of the playing cards, along a serpentine extension of the processing plane x. The means D is characterized by top and bottom absorbent wiping towels in belt form of the same width as the scrubbing means rollers and opposed to the top and bottom sides of the playing cards as they issue from the transport rollers 32–33. The top and bottom belts 54 and 55 are alike, and are made of a deep pile cotton toweling such as "Terry Cloth" or the like (see FIG. 8). In practice, said toweling is backed in each instance by a flexible belt of stretch resistant material 54' and 55', perforated so as to allow evaporation therethrough. The belts of toweling 54 and 55 are trained over horizontally spaced rollers 56 and 57, and over spaced rollers 58 and 59, each with widely spaced top and bottom rollers 60 and 61 that form large loops thereof for the evaporation of moisture therefrom. The rollers 56 and 58, and the rollers 57 and 59 are juxtapositioned so that the belts of toweling press together for the pressured engagement of the playing cards inserted therebetween for drying by absorbtion of dampness into the pile of the toweling.

In accordance with this invention, the playing cards are effectively wiped dry by the toweling through the establishment of a serpentine route of travel. As shown, the rollers 57 and 58 are driven by the chain 41 through sprockets 62 and 63, so that the belts of toweling 54 and 55 advance at the same positive rate of speed; the same peripheral speed as the scrubbing means transport rollers. In practice, the drive rollers 57 and 58 are made with surfaces of resilient or compressive material such as rubber or the like, while the intermediate rollers are hard faced of plastic or the like. Wiping action is established by change in rate of travel, there being alternate high and low rollers to effect this serpentine principle of operation. In practice, there are four equally spaced high periphery rollers supporting the lower belt toweling 55, and there are three intermediate low periphery rollers depressing the upper belt toweling (see FIG. 7).

As the playing cards pass over and under these high and low periphery rollers, they are flexed and wiped against said belting through changes in speed of one belt relative to the other as deviation in direction of travel occurs. The playing cards are wiped clean of dampness and are discharged from the absorbent toweling at the rollers 57 and 59, where they drop into the receptacle R for subsequent collection and reuse.

In accordance with the method performed by the apparatus-machine hereinabove disclosed, a minimal amount of liquid cleaner is used in the scrubbing step wherein the liquid cleaner is applied to the playing card surfaces in a thin film and squeezed rearwardly as the playing cards are issued in a damp condition into the drying means. The cleaner solution employed herein includes an antistatic conditioner liquid as is disclosed in U.S. Pat. No. 3,442,692 issued to Conrad J. Gaiser May 6, 1919, a liquid as in aqueous or aqueous-alcohol solution or in dispersion form, generally cation-active substances. The most effective static conditions are cationics. However, some anionics such as calcium and magnesium salts of ordinary fatty acids of 14 to 18 carbon atoms chain length are also effective. Some of the amphoteric molecues are also effective. Effective softening agents are:

(a) Primary, secondary, and tertiary amines and their water soluble or water dispersible salts.
(b) Quaternary nitrogen-containing base or salt.
(c) Alkyl imidazolines and imidazolas.
(d) Alkyl pyridine and piperidine.
(e) Alkyl sulfonium salts.
(f) Alkyl phosphonium salts.
(g) Esters of amino acids.
(h) Esters of amina alcohols.
(i) Alkyl guanidines and their salts.

Effective softening agents are quaternary ammonium chlorides or bromides, and alkyl imidazolinium chlorides or bromides. Suitable as antistatic agents are alkyl dibenzyl ammonium chlorides and alkyl amines. An example of a basic softening-antistatic solution is a dispersion of 2.0 grams of dimethyl, di(hydrogenated tallow), ammonium chloride (a quaternary ammonium compound known as "Arquad 2HD-75" by Armour Chemical Company) in 7.0 cc of water and 1.5 cc of isopropanol, prepared at 18° C. Alkyl dimethyl benzylammonium chlorides and diodecyl trimethyl ammonium chloride are desirable bacterio-static agents.

The cleaner solution employed herein may also include other cationic, anionic and nonionic softeners as disclosed in U.S. Pat. No. 3,944,694 issued to Agnes R. McQueary Mar. 16, 1976. Other cationic quaternary ammonium softeners are, for example, alkyl ($C_{12}$ to $C_{22}$)-pyridinium chlorides, alkyl ($C_{12}$ to $C_{22}$)-alkyl ($C_1$ to $C_3$)-morpholinium chlorides, and quaternary derivatives of amino acids and amino esters. Anionic conditioning agents can include any of the various surface-active anionic softening and antistatic agents such as alkali metal or ammonium salts of higher fatty alcohol sulfates, higher fatty alcohol ether sulfates, higher fatty alcohol sulfonates, the linear higher alkyl benzene sulfonates, the higher fatty acyl taurides and isethionates. Generally, the cation of such compounds will be an alkali metal or other water-solubilizing radical. The hydrophobic moiety of such compounds will normally contain from 10 to 22 carbon atoms. Alkali metal and ammonium soaps of fatty acids of from 10 to 22 carbon atoms can also be employed and include the sodium or potassium coconut or tallow soaps. Suitable nonionic softeners and antistatic agents that can be employed are the polyoxyaikylene glycols, the higher fatty alcohol esters of polyoxyalkylene glycols, and the higher fatty alcohol ethers of polyoxyalkylene glycols. Also suitable are the ethoxylates of long-chain alcohols of from 8 to 22 carbon atoms such as the ethoxylates of tallow alcohol with, for example, 10 to 40 moles of ethylene oxide. Other nonionics include the amides such as the alkanolamides, e.g., the higher fatty amides and higher fatty acid mono- and di-lower alkanolamides, wherein the long-chain hydrophobic groups have from 10 to 22 carbon atoms.

In carrying out this invention, the amount used of any one of the above softening agents is variable and depends upon the characteristics of the agent employed. In practice, about 1.0 to 10.0 grams of agent is dissolved into 10 to 12 oz. of soda water. The soda water is useful for removing odors and is produced, for example, by the reaction of soda ash $Na_2CO_3$ with carbon dioxide $CO_2$, as in the manufacture of beverages and namely "Club Soda". The ingrediendts of this solution or beverage is generally accepted to be: carbonated water, sodium bicarbonate, sodium citrate, and salts consisting of sodium phosphate and potassium sulfate. The solution thus far described is a concentrate for the purpose of the playing card cleaning process herein disclosed, and is diluted about five to one with 10 to 12 oz. of freshly de-capped soda water which fills the basin 50 hereinabove described. It is to be understood that the playing cards are simultaneously scrubbed and squeegeed with the above described cleaner and soda water solution, leaving them slightly damp at the most, and when dry or substantially so they are clean and remarkably slick.

Having described only the typical preferred form and application of my invention, I do not wish to be limited or restricted to the specific details herein set forth, but wish to reserve to myself any modifications or variations that may appear to those skilled in the art as set forth within the limits of the following claims.

I claim:

1. A playing card cleaning apparatus including;

separating means sequentially feeding the cards in spaced planar relation disposed forwardly into a processing plane, scrubbing means comprised of, a first pair of traction rollers pressed together at said processing plane to receive and drive cards therethrough, a pair of scrubbing rollers positioned forward of the first pair of traction rollers and pressed together at said processing plane to receive said cards simultanesouly engaged with the first pair of traction rollers, and a second pair of traction rollers positioned forward of the scrubbing rollers and pressed together at said processing plane to receive said cards simultaneously engaged with the pair of scrubbing rollers, means positively driving the two pairs of traction rollers forwardly at the same peripheral rate and positively driving the pair of scrubbing rollers forwardly at a lesser peripheral rate than the peripheral rate of the two pairs of traction rollers, whereby a scrubbing action is effected by the pair of scrubbing rollers, means wetting the scrubbing rollers with a liquid cleaning solution transferred thereby onto opposite sides of the cards and simultaneously squeegeed therefrom, and drying means extended from the processing plane and receiving scrubbed cards from the scrubbing means and drying the same.

2. The playing card cleaning apparatus as set forth in claim 1, wherein the two pairs of traction rollers and pair of scrubbing rollers have compressive peripheries for pressured engagement with the cards passing therethrough, whereby the sequentially fed cards are compressed between the first mentioned traction rollers and scrubbing rollers and then tensioned between the second mentioned traction rollers and scrubbing rollers while the liquid cleaning solution is squeegeed rearwardly from each sequential card.

3. The playing card cleaning apparatus as set forth in claim 1, wherein the two pairs of traction rollers and pair of scrubbing rollers have compressive peripheries for pressured engagement with the cards passing therethrough, wherein means presses the scrubbing rollers together less tightly than the pressure applied between each of the two pairs of traction rollers, whereby the sequentially fed cards are compressed between the first mentioned traction rollers and scrubbing rollers and then tensioned between the second mentioned traction rollers and scrubbing rollers while the liquid cleaning solution is squeegeed rearwardly from each sequential card.

4. The playing card cleaning apparatus as set forth in claim 1, wherein the separating means comprises a feed shoe for gravity feed of decks of cards with each successive card disposed in a transverse vertical plane and in engagement with side stops, a suction cup engageable with the foremost card, a drive means altrnately advancing said cup into compressive engagement with said foremost card and retracting said cup to withdraw said foremost card from the side stops, and valve means opening said cup to atmosphere in resonpose to retraction thereof for release of said foremost card to drop the same by means of gravity.

5. The playing card cleaning apparatus as set forth in claim 1, wherein the separating means comprises a declined feed shoe for gravity feed of decks of cards with each successive card disposed in a transverse vertical plane and in engagement with side stops, a suction cup engageable with the foremost card, a motor drive means with a crank and connecting rod alternately advancing said cup into compressive engagement with said foremost card and retracting said cup to withdraw said foremost card from the side stops, and valve means carried by said cup and opening into a chamber formed thereby and opening the said chamber to atmosphere in response to retraction thereof and engagement with a fixed pin for release of suction from said foremost card to drop the same by means of gravity.

* * * * *